US007699098B2

(12) United States Patent
Hamilton

(10) Patent No.: US 7,699,098 B2
(45) Date of Patent: Apr. 20, 2010

(54) APPARATUS FOR STABBING PIPE WHEN USING AN IRON ROUGHNECK

(75) Inventor: William R. Hamilton, Conroe, TX (US)

(73) Assignee: Blohm & Voss Oil Tools, LLC, Houston, TX (US)

( * ) Notice: Subject to any disclaimer, the term of this patent is extended or adjusted under 35 U.S.C. 154(b) by 101 days.

(21) Appl. No.: 11/890,582

(22) Filed: Aug. 8, 2007

(65) Prior Publication Data

US 2009/0038857 A1 Feb. 12, 2009

(51) Int. Cl.
*E21B 19/00* (2006.01)
*E21B 19/18* (2006.01)

(52) U.S. Cl. ..... 166/77.51; 166/85.5; 414/22.71

(58) Field of Classification Search ..... 166/85.5, 166/77.51; 175/52, 85; 414/22.68, 22.71
See application file for complete search history.

(56) References Cited

U.S. PATENT DOCUMENTS 3,780,815 A * 12/1973 Barron et al. ..... 173/195
4,591,006 A * 5/1986 Hutchison et al. ..... 175/52
7,188,547 B1 * 3/2007 West et al. ..... 81/57.16
2001/0042625 A1 * 11/2001 Appleton ..... 166/379
2002/0134555 A1 * 9/2002 Allen et al. ..... 166/377
2004/0045703 A1 * 3/2004 Hooper et al. ..... 166/77.51
2004/0216890 A1 * 11/2004 Hemphill et al. ..... 166/380
2008/0245522 A1 * 10/2008 Hamilton ..... 166/77.51

* cited by examiner

*Primary Examiner*—William P Neuder
*Assistant Examiner*—Catherine Loikith
(74) *Attorney, Agent, or Firm*—Gifford, Krass, Sprinkle, Anderson & Citkowski, P.C.

(57) ABSTRACT

Drilling apparatus for receiving, moving and aligning pipe sections as they are added to a string of pipe on a drilling rig when using an iron roughneck. After the iron roughneck is moved to well centerline and engaged with the box connection of the pipe suspended in the well bore, a hydraulically controlled pipe engagement mechanism is extended radially away from the iron roughneck and in the general direction of the pipe rack. The pipe engaging mechanism receives the lower end of the next stand of pipe to be added and is hydraulically retracted to lock around the pipe stand and bring the pipe stand into alignment with the pipe string suspended in the well bore.

10 Claims, 6 Drawing Sheets

APPARATUS FOR STABBING PIPE WHEN USING AN IRON ROUGHNECK

FIELD OF THE INVENTION

This invention relates generally to rotary drilling apparatus for oil and gas wells and in particular to an apparatus for stabbing drill pipe and other tubular products used in drilling wells when using an iron roughneck machine.

BACKGROUND OF THE INVENTION

Rotary drilling operations for oil and gas wells generally employs a drill string consisting of many joints of drill pipe at the top of the string and several joints of drill collars at the bottom of the string nears the bit.

Periodically during the drilling of a well the drill string, partially or entirely, must be removed from the hole. Such cases include the need for changing bits, running casing or for other reasons. Also, as the drilling progresses and the borehole becomes deeper, additional joints or stands of pipe must be added for drilling to continue.

To add or remove drill pipe or drill collar segments to or from the drill string, the existing connections between the drill pipe or drill collar segments must be broken loose and then rotated multiple times to disengage the threaded connection and separate the segments so the segments may be removed from the drill string. The pipe sections, known as "stands" of pipe may be comprised of one or more individual pipe joints depending on the particular configuration of the drilling rig. When the pipe string is reassembled into the well bore, the opposite procedure is followed. The pipe sections must be reinserted, rotated clockwise and retightened before drilling can recommence. For these operations, current art often utilizes large machines known as "iron roughneck" machines, to hydraulically make these connections. When recombining the pipe segments into a continuous string inside the well bore, it is necessary to guide the next stand to be added into alignment with the drill string suspended in the well bore. This portion of the operation is known as "stabbing the pipe". On large or specialized rigs, expensive and complex pipe handling machines are sometimes used to move pipe between the setback area or pipe rack and the well center in preparation for reattaching the next pipe segment in the string. On most rigs, however, the pipe is lifted with elevators attached to the rig's hoisting equipment and the male threaded segment of the tool joint, or "pin", is manually guided into alignment with the female threaded segment of the tool joint, or "box", of the drill string suspended in the well bore. Due to the movement of the pipe being added, this process is somewhat inexact and "mis-stabs" are common, resulting in scarring of the sealing face of the tool joint. Due to the proximity of the rig personnel to the well center, it is also somewhat dangerous.

When using an "Iron Roughneck" type machine, much of the danger for the rig personnel is reduced during tripping operations but the risks inherent in manually stabbing pipe remain.

Additionally, when tripping with manual tongs, in order to speed operations, it is common to clamp the lower tong onto the box portion of the tool joint of the top segment of the drill string the suspended in the well bore before stabbing the pin portion of the next stand of pipe to be added into it. When using an iron roughneck, this practice is seldom used because of the increased risk of injury from accidental pinching of the hands of the rig personnel between the moving pipe and the stationary iron roughneck. Current practice when using an iron roughneck is to wait until the pipe is manually stabbed before engaging the iron roughneck with the drill string. This delay results in lost rig time.

SUMMARY OF THE INVENTION

The present invention provides for an economical and versatile alternative method for stabbing drill pipe and drill collars when using an iron roughneck. The central entity in the invention is a pipe engagement mechanism which encircles the lower end of the stand of pipe, restraining the lateral motion of the pipe while allowing it to move vertically. Said mechanism is mounted within the envelope of the iron roughneck but is moveable outwardly from it. This capability allows the iron roughneck to be engaged with the box end of the top tool joint of the drill string suspended in the well bore early in the tripping cycle before the blocks have reached the upward end of their travel. Since this portion of the operation is normally a mostly "idle time" for the floor personnel, any operations that may be moved to this period will inherently decrease the cycle time. Further, such operations may be made at a slower, safer pace and should lead to fewer accidents. Using the present invention, the process steps of moving the iron roughneck from its standby position to well center, locating the tool joint both laterally and vertically and clamping the lower wrench onto said tool joint box may be done in the aforesaid idle time thus increasing safety while decreasing the overall cycle time for tripping. After the blocks have reached their upper end of their travel and the elevator has been latched around next pipe stand, said pipe stand is lifted off of the pipe setback area with the elevators and the lower end of said pipe stand is guided by rig personnel into the pipe engagement mechanism of the stabbing device of the present invention in its extended position away from the iron roughneck. When the lower end of said pipe stand is restrained within the pipe engagement mechanism, the pipe engagement mechanism is retracted to bring the lower end of the pipe stand toward the iron roughneck and into alignment with the drill string already suspended in the well bore. During this retraction, the first portion of movement causes the lock portion of the pipe engagement mechanism to actuate, fully restraining the lateral motion of the pipe within the pipe engagement mechanism. After this initial retraction but still well away from the iron roughneck, the rig personnel are free to move away from both the pipe and the iron roughneck.

DESCRIPTION OF THE PREFERRED EMBODIMENT OF THE INVENTION

The preferred embodiment of a pipe stabbing device of the present invention is shown is the appended drawings and as described herein. In all cases, the pipe stabbing device of the present invention is mounted above the upper wrench assembly of the iron roughneck. Depending on the configuration of the iron roughneck, the pipe stabbing device of the present invention may be mounted above or below the pipe spinner portion of the iron roughneck.

FIG. 1 illustrates the stationary base 6 of a pipe stabbing device of the present invention mounted atop the spinner portion 7 of the iron roughneck 1. The lower wrench 8 of the iron roughneck 1 is shown positioned and clamped onto the uppermost tool joint box of drill string 2 suspended in the well bore. The drill string 2 is supported by the rig structure 3. Further shown is the lower end of the pipe stand to be added 4 in initial engagement with the extended pipe engagement mechanism 5. The pipe engagement mechanism 5 is supported by rails 10*a* (shown) and 10*b* (not shown). In this position the lower end of the pipe stand to be added 4 is away from the bulk of the iron roughneck 1 thus greatly reducing the possibility for pinching the hands of the rig personnel between the lower end of the pipe stand to be added 4 and the iron roughneck 1.

FIG. 2 is similar to FIG. 1 and illustrates the pipe engagement mechanism 5 of a pipe stabbing device of the present invention in the retracted position. In this position the pin portion 11 of the lower end of the pipe stand to be added 4 is within the spinner portion 7 and upper wrench 9 of iron roughneck 1 and is in alignment with the box portion 12 of the uppermost portion of the drill string 2 suspended in the well bore. The lower end of the pipe stand to be added 4 is now in position to be lowered whereby the pin portion 11 will be stabbed into the box portion 12 of the uppermost portion of the drill string 2 suspended in the well bore.

FIG. 3 is similar to FIG. 1 but illustrates the preferred embodiment of a pipe stabbing device of the present invention in the extended position in greater detail. FIG. 4 is the top view of the stabbing device of the present invention as defined in FIG. 3. The stationary base 6 of the pipe stabbing device of the present invention is mounted directly to the top of the pipe spinner portion 7 of the iron roughneck 1. The rotatable base 13 is fixed with respect to axle 14. The axle 14 and thereby the rotatable base 13 are able to be rotated with respect to the stationary base 6 and thus with respect to the remainder of the iron roughneck. Rails 10*a* and 10*b* as well as hydraulic cylinder 15 are affixed to the rotatable base 13. The pipe engagement mechanism 5 is supported by rails 10*a* and 10*b* by way of bearing means 17*a*, 17*b*, 17*c*, and 17*d* and is slideable axially with respect to said rails 10*a* and 10*b*. The rod 16 of the hydraulic cylinder 15 is attached to the pipe engagement mechanism thereby providing power to extend or retract the pipe engagement mechanism along rails 10*a* and 10*b* and with respect to the rotatable base 13. A pair of fixed arms 32*a* and 32*b* extend from a distal end of the pipe engagement mechanism, which is opposite from the end to which the rod 16 is attached.

FIGS. 5 and 6 are similar to FIGS. 3 and 4 respectively except that the pipe engagement mechanism 5 and thereby the lower end of the pipe stand 4 are shown in the retracted position. Affixed to stationary base 6 is gearbox 18, operated by hand wheel 19. Pinion gear 20 is affixed to the output shaft 21 of gearbox 18. When hand wheel 19 is rotated, gearbox 18 causes output shaft 21 and thereby pinion gear 20 to rotate. The rotation of pinion gear 20 acting upon circular gear rack 22, an integral part of rotatable base 13, causes rotatable base 13 and axle 14 to be slewed with respect to stationary base 6. This slewing motion allows lateral adjustments to be made to the position of the lower end of the pipe stand to be added 4.

FIG. 7 illustrates a plan view of the pipe stabbing device of the present invention with the pipe engagement mechanism 5 in the extended position and the lower end of the next stand of pipe to be added 4 ready to be introduced into the pipe engagement mechanism 5. A pair of locking arms 23*a* and 23*b* are pivotally attached to a terminal end of the fixed arms 32*a* and 32*b* about a pivot pins 26*a* and 26*b*. The partial section illustrates how locking arm 23*a* is disengaged as roller 24*a*, beneath locking arm 23*a*, is not in contact with the tapered face 25*a* of rail 10*a* and is allowed to pivot outwardly about pin 26*a*. Similarly locking arm 23*b* is disengaged as roller 24*b* (not shown) is not in contact with the tapered face 25*b* (not shown) of rail 10*b* and is allowed to pivot outwardly about pin 26*b*. Insert 30 has an inside bore 31 that is compatible with the outside diameter of the next stand of pipe to be added 4, and has a pair of restraining fingers 27*a* and 27*b* which define an open end. Insert 30 is made of plastic with a center bore 31 of a slightly larger diameter than the outside diameter of the lower end of the next stand of pipe be added 4.

FIG. 8 is similar to FIG. 7 and illustrates the lower end of the next stand of pipe being added 4 in partial engagement with the pipe engagement mechanism 5. As the next stand of pipe to be added 4 is pushed into insert 30 of pipe engagement mechanism 5, it causes the restraining fingers 27*a* and 27*b* of the insert 30 to separate until the pipe 4 is within the bore 31 of insert 30 of pipe engagement mechanism 5.

FIG. 9 is similar to FIGS. 7 and 8 and illustrates the operation of the locking arms 23*a* and 23*b* upon initial retraction of the pipe engagement mechanism 5. When the next stand of pipe to be added 4 is within the pipe engagement mechanism 5, cylinder 15 is actuated and pipe engagement mechanism 5 is retracted. As pipe engagement mechanism 5 retracts, roller 24*a* comes into contact with the tapered face 25*a* of rail 10*a* causing it to pivot about pin 26*a*. Locking pin 28*a* is affixed to locking arm 23*a* and moves inwardly toward restraining finger 27*a* by the pivoting of locking arm 23*a* about pin 26*a*. Similarly, as pipe engagement mechanism 5 retracts, roller 24*b* (not shown but similarly affixed to locking arm 23*b*) comes into contact with the tapered face 25*b* (not shown) of rail 10*b* causing locking arm 23*b* to pivot about pin 26*b*. Locking pin 28*b* is affixed to locking arm 23*b* and moves inwardly toward restraining finger 27*b* by the pivoting of locking arm 23*b* about pin 26*b*. Because of the inward position of locking pins 28*a* and 28*b*, restraining fingers 27*a* and 27*b* of insert 30 are prevented from moving outwardly thus restraining the next stand of pipe to be added 4 within pipe engagement mechanism 5.

FIG. 10 is a top view of a pipe stabbing device of the present invention illustrating the rotatable base in the fully slewed position. This position is used in the events that the pipe stabbing device is not needed. Such events include removing the drill string from the well bore (known as "tripping out of the hole") or when handling tubulars not compatible with the pipe stabbing device of the present invention.

FIG. 11 is a hydraulic schematic of a pipe stabbing device of the present invention. A hydraulic valve 29 is actuated causing hydraulic cylinder 15 to extend cylinder rod 16 to move the pipe engagement mechanism 5 (not shown) to the extended position. When hydraulic valve 29 is actuated in the opposite direction, hydraulic cylinder 15 retracts cylinder rod 16 to move the pipe engagement mechanism 5 (not shown) into the retracted position. When hydraulic valve 29 is released, it returns to the center position wherein both sides of hydraulic cylinder 15 are open to the tank line. This position of hydraulic valve 29 allows the pipe engagement mechanism to float when external forces act upon the pipe engagement mechanism 5. This float feature is particularly useful when the iron roughneck is moved from the well center as it allows the pipe engagement mechanism 5 to remain locked to the pipe until the end of its travel where the pipe engagement mechanism 5 automatically disengages from the lower end of the pipe stand to be added 4 now attached to the drill string suspended in the well bore 2.

In alternate embodiments of manipulators of the present invention, pneumatic circuitry may be used in place of hydraulics.

In the preferred embodiment of the present invention, pipe engagement means is fitted with replaceable inserts made of plastic or an elastomer with a center bore of a slightly larger diameter than the outside diameter of the lower end of the next stand of pipe be added. It is clearly obvious that the replaceable insert may be replaced by other means of adaptation for different pipe sizes. Other variations might also include a metallic sizing elements with spring loaded restraining fingers 27*a* and 27*b*.

Figure 2:
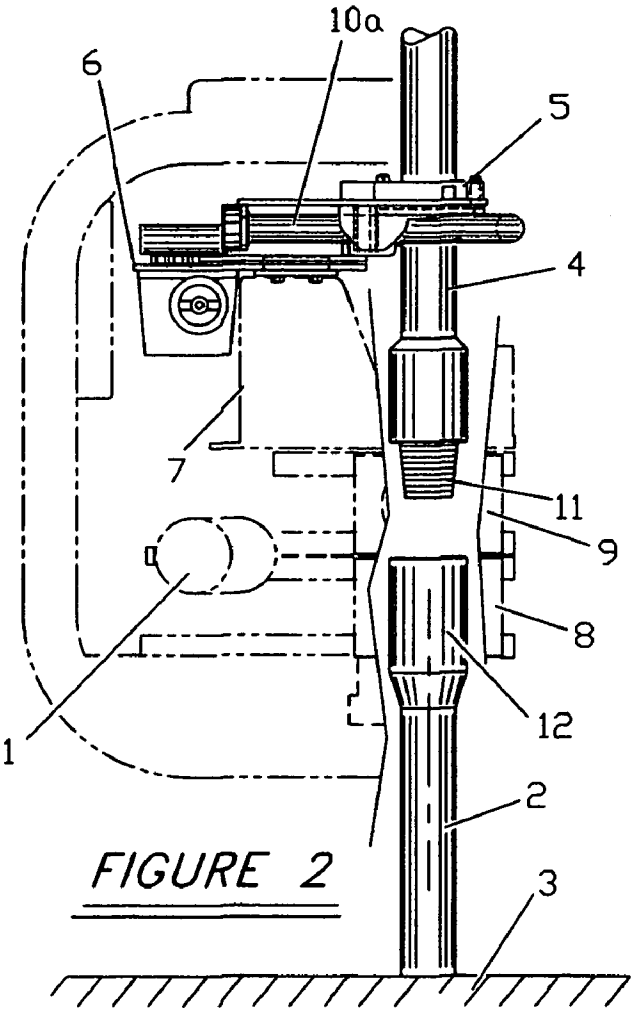
FIG. 2 is a view similar to FIG. 1 illustrating the pipe engagement mechanism in the retracted position.
Figure 1:
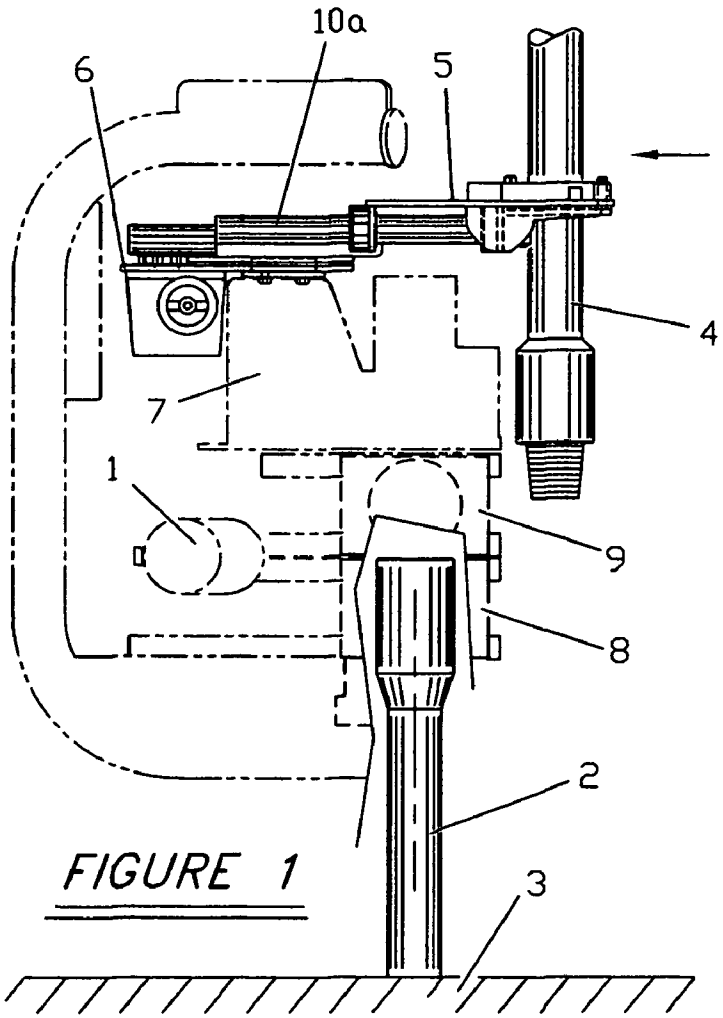
FIG. 1 is a side view of the present invention illustrating the pipe engagement mechanism in the extended position.
Figure 4:
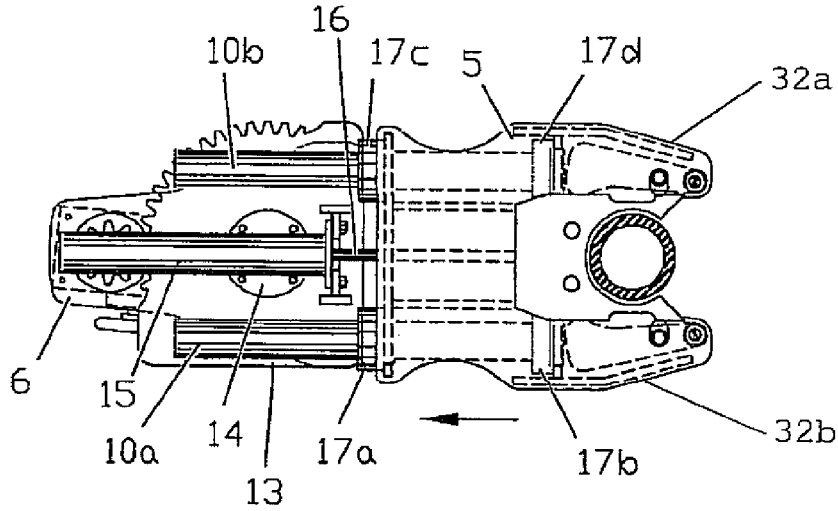
FIG. 4 is a top view as defined in FIG. 3.
Figure 3:
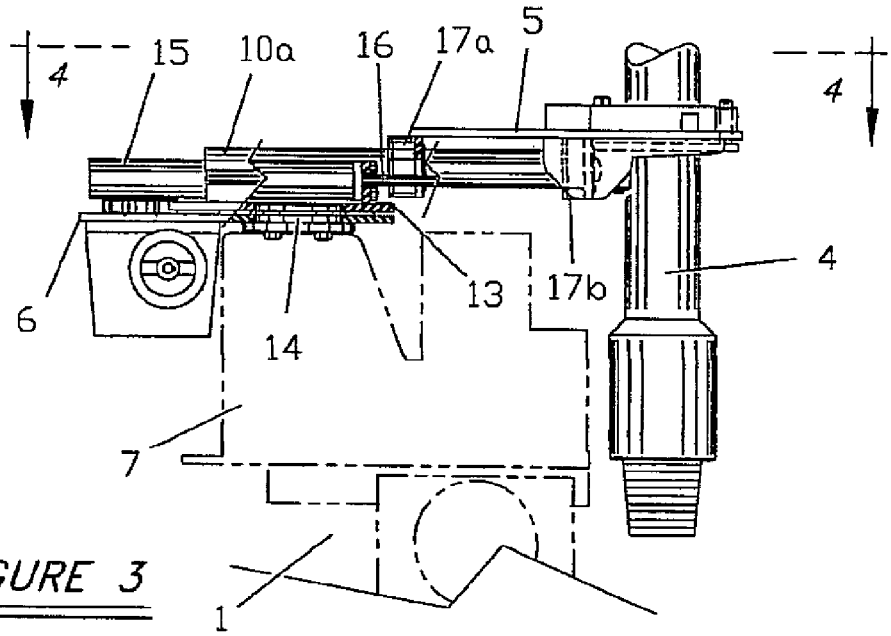
FIG. 3 is a side and partially sectioned view similar to FIG. 1 illustrating the pipe engagement mechanism in the extended position.
Figure 6:
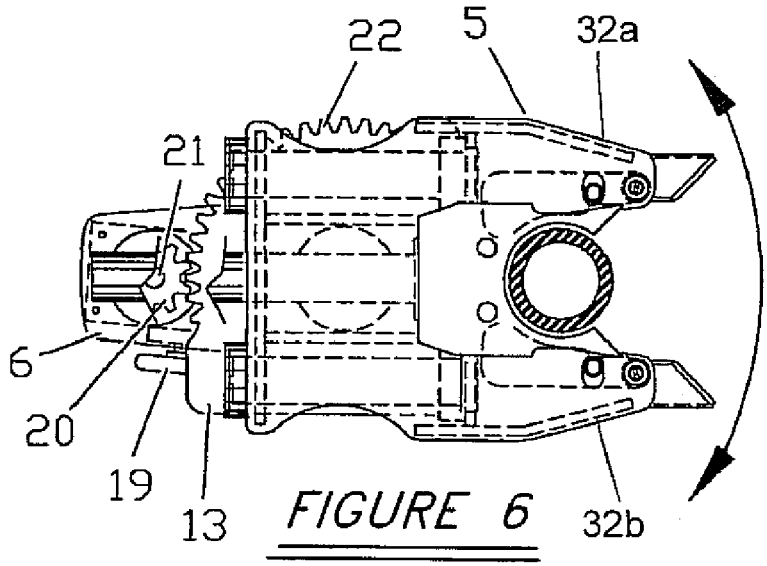
FIG. 6 is a top view as defined in FIG. 5.
Figure 5:
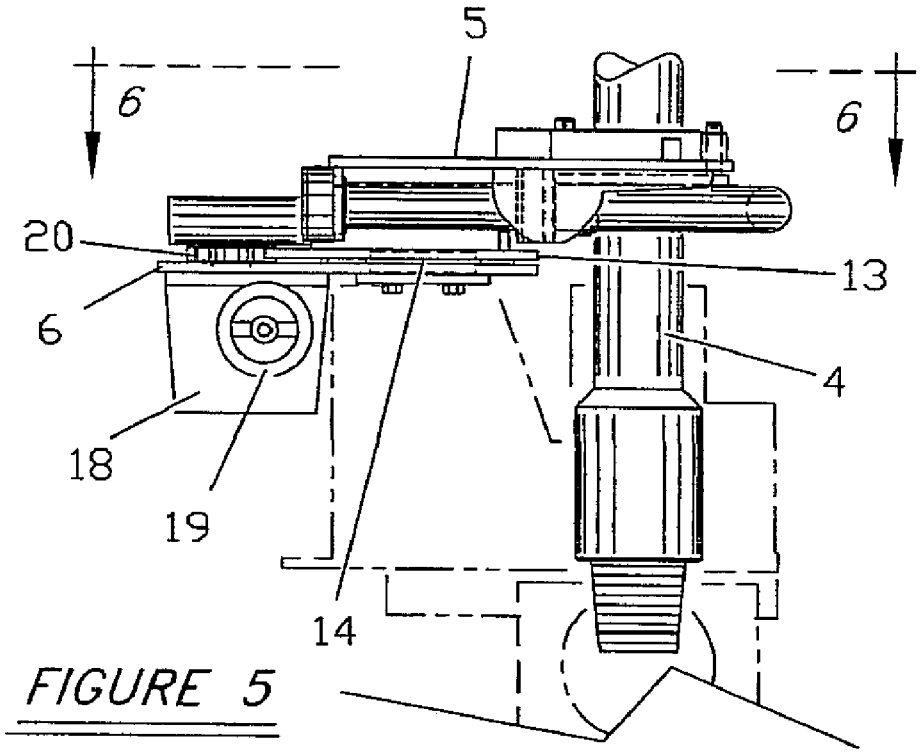
FIG. 5 is a side and partially sectioned view similar to FIG. 3 illustrating the pipe engagement mechanism in the retracted position.
Figure 7:
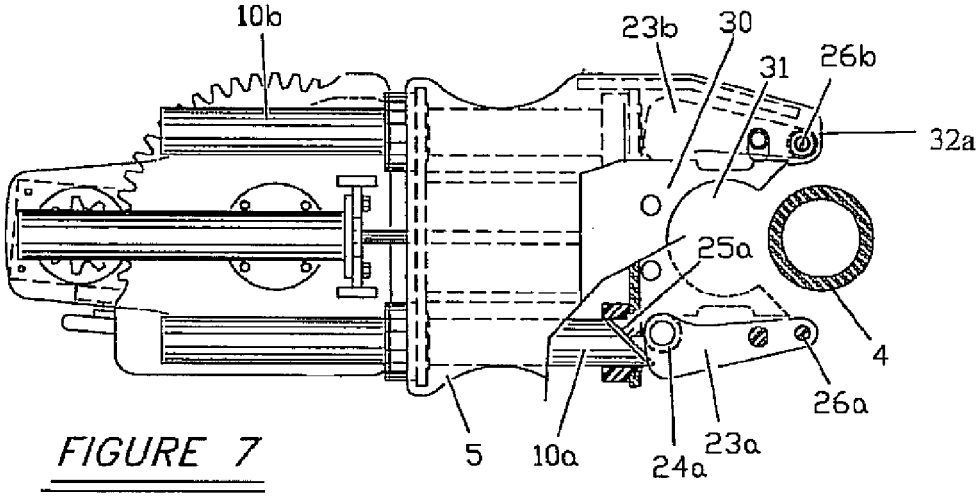
FIG. 7 is a top view similar to FIG. 4 illustrating the pipe engagement mechanism in the extended position prior to receiving the pipe.
Figure 8:
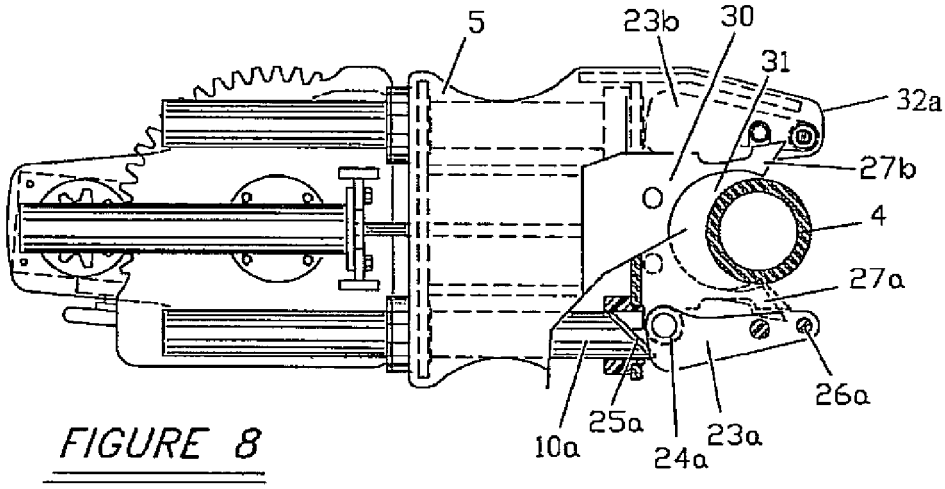
FIG. 8 is a top view similar to FIG. 7 illustrating the pipe engagement mechanism in the extended position as the pipe enters the pipe engagement mechanism.
Figure 9:
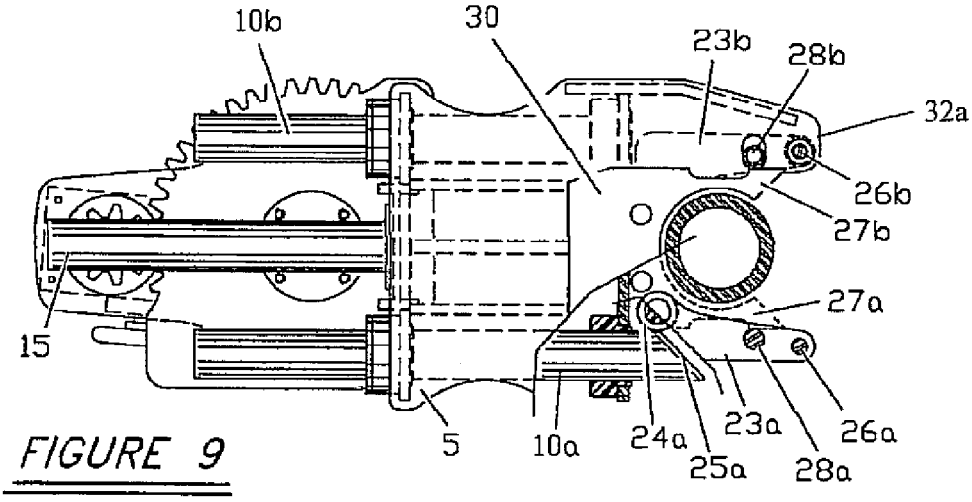
FIG. 9 is a top view similar to FIGS. 7 and 8 illustrating the pipe engagement mechanism in the partially retracted position with the pipe restrained by the pipe engagement mechanism.
Figure 10:
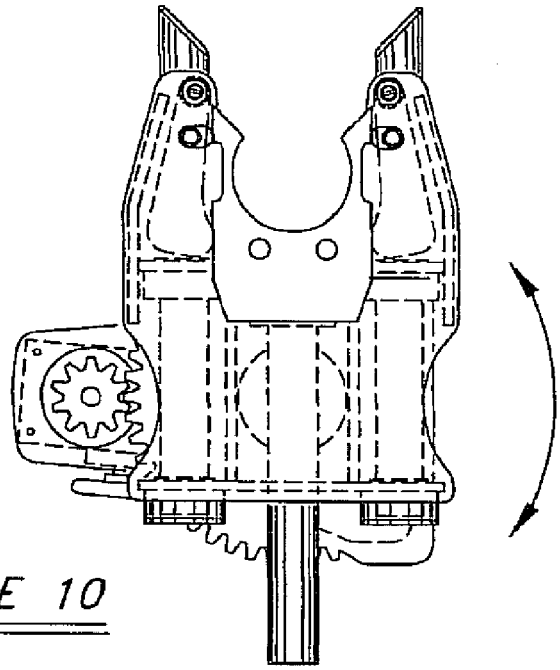
FIG. 10 is a top view illustrating the pipe engagement mechanism in the fully slewed position.
Figure 11:
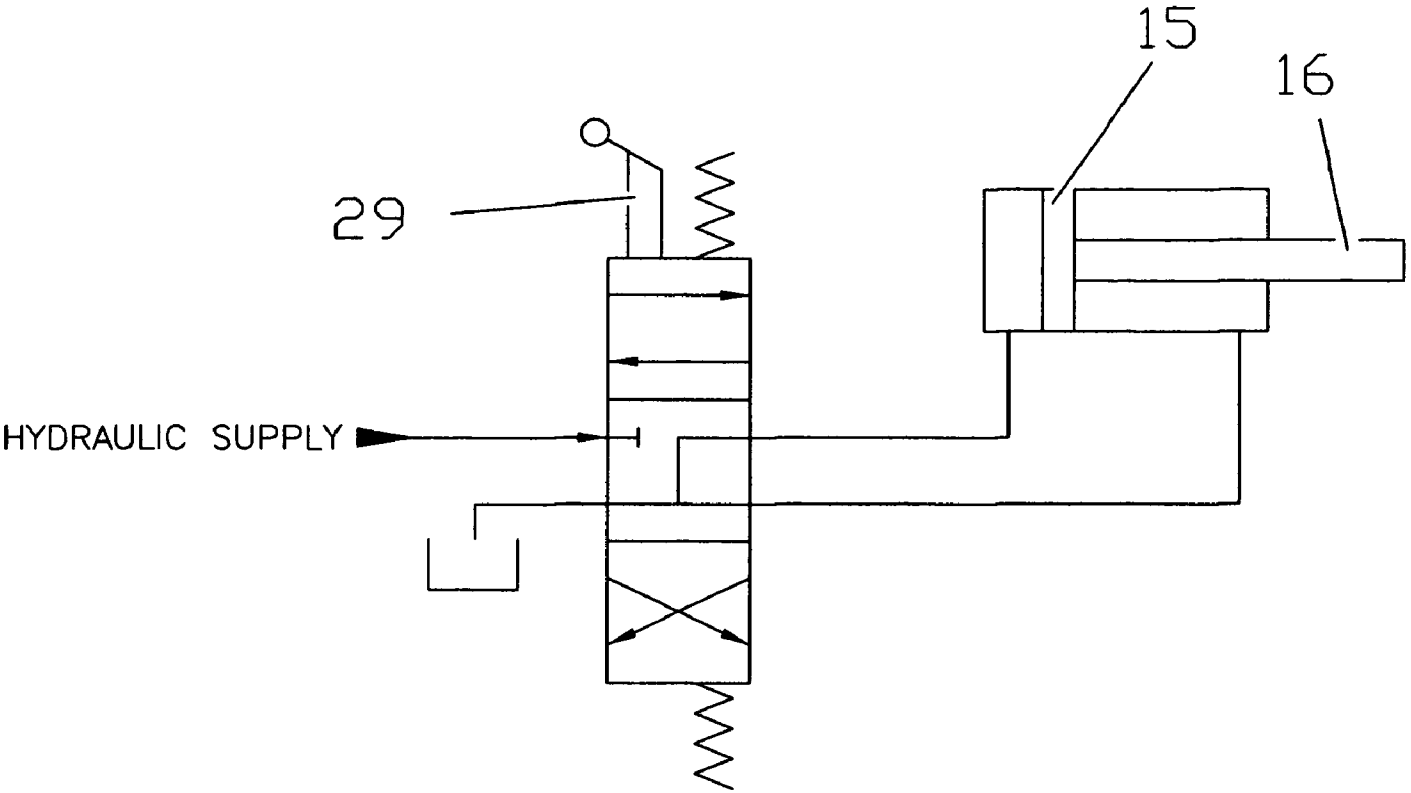
FIG. 11 is a hydraulic schematic of the pipe stabbing device of the present invention.

I claim:

1. An apparatus for connecting and disconnecting a mating section of a drill pipe to a mating section of a drill string said apparatus comprising:

an iron roughneck having an upper wrench for contacting the drill pipe, and a lower wrench for contacting the drill string;

a pipe engagement mechanism slidingly mounted to said iron roughneck above said upper wrench, said pipe engagement mechanism moveable between an extended position and a retracted position to align the mating section of the drill pipe with the mating section of the drill string;

a pair of fixed arms each having a proximate end and an opposite terminal end, said proximate ends connected to a distal end of said pipe engagement mechanism;

a pair of locking arms each having a first end and an opposite second end, each of said second ends being pivotally attached to one of said terminal ends of said pair of fixed arms, and each of said first ends being positioned adjacent said distal end of said pipe engagement mechanism; and an insert attached to a distal end of said pipe engagement mechanism between said pair of fixed arms and said pair of locking arms, said insert having an open end defined by a pair of restraining fingers;

said insert receives the drill pipe between said pair of restraining fingers when in said extended position, and upon movement towards said retracted position said pair of locking arms pivot to abut said pair of restraining fingers and narrow said open end to restrain lateral movement of the drill pipe.

2. The apparatus of claim 1, further comprising a base rotatably attached to said iron roughneck above said upper wrench, and wherein said pipe engagement mechanism is slidingly attached to said base.

3. The apparatus of claim 1, wherein said pair of restraining fingers define an inside bore slightly larger than an outer diameter of the drill pipe.

4. The apparatus of claim 1, wherein said pipe engagement mechanism is slidingly attached to said base by a pair of rails.

5. The apparatus of claim 4, wherein said pair of rails are aligned with said pair of fixed arms.

6. The apparatus of claim 1, wherein a terminal end of each of said pair of restraining fingers are tapered inwardly to facilitate said insert receiving the drill pipe.

7. The apparatus of claim 1, wherein each of said pair of locking arms has a locking pin affixed thereto, and wherein upon movement of said pipe engagement mechanism from said extended position and towards said refracted position said locking pins abut said pair of restraining fingers to narrow said open end to restrain lateral movement of the drill pipe.

8. An apparatus for connecting and disconnecting a mating section of a drill pipe to a mating section of a drill string said apparatus comprising:

an iron roughneck having an upper wrench for contacting the drill pipe, and a lower wrench for contacting the drill string;

a base mounted to said iron roughneck above said upper wrench;

a pipe engagement mechanism slidingly mounted to said base by a pair of rails, said pipe engagement mechanism moveable between an extended position and a refracted position to align the mating section of the drill pipe with the mating section of the drill string;

a pair of fixed arms with terminal ends extending from a distal end of said pipe engagement mechanism in alignment with said pair of rails;

a pair of locking arms each having a first end and an opposite second end, each of said second ends being pivotally attached to one of said terminal ends of said pair of fixed arms;

a roller attached to each of said first ends of said pair of locking arms; and an insert attached to a distal end of said pipe engagement mechanism between said pair of fixed arms and said pair of locking arms, said insert having an open end defined by a pair of restraining fingers;

said insert receives the drill pipe between said pair of restraining fingers when in said extended position, and upon movement towards said refracted position said pair of locking arms pivot to abut said pair of restraining fingers and narrow said open end to restrain lateral movement of the drill pipe.

9. The apparatus of claim 8, wherein upon movement of said pipe engagement mechanism from said extended position to said retracted position, said rollers contact said pair of rails and pivot said pair of locking arms to abut said pair of restraining fingers to narrow said open end.

10. The apparatus of claim 9, wherein one end of each of said pair of rails has an inwardly tapered face (25*a*, 25*b*) to facilitate contact with said rollers.

* * * * *